US006379002B1

(12) United States Patent
Kodama et al.

(10) Patent No.: US 6,379,002 B1
(45) Date of Patent: Apr. 30, 2002

(54) RECORDING DEVICE AND METHOD, AND FEEDER

(75) Inventors: Jun Kodama; Katsuyasu Itoh, both of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/457,293

(22) Filed: Dec. 9, 1999

(30) Foreign Application Priority Data

Jun. 7, 1999 (JP) ..... 11-159044

(51) Int. Cl.[7] ..... B41J 2/01; B41J 2/06
(52) U.S. Cl. ..... 347/101; 347/55
(58) Field of Search ..... 8/436; 347/55, 347/101

(56) References Cited

U.S. PATENT DOCUMENTS 5,676,707 A * 10/1997 Kuwabara et al. ..... 347/101
5,969,740 A * 10/1999 Maeda et al. ..... 347/101
6,002,895 A * 12/1999 Kasuya et al. ..... 399/11
6,074,052 A * 6/2000 Inui et al. ..... 347/101
6,164,761 A * 12/2000 Numata ..... 347/55
6,097,408 A1 * 8/2001 Fukushima et al. ..... 347/34

OTHER PUBLICATIONS

Patent Abstract of Japan No. 56–51369, dated May 8, 1981.
Patent Abstract of Japan No. 06191662, dated Jul. 12, 1994.
Patent Abstract of Japan No. 09030041, dated Feb. 4, 1997.
Patent Abstract of Japan No. 09254460, dated Sep. 30, 1997.

* cited by examiner

*Primary Examiner*—John S. Hilten
*Assistant Examiner*—Marvin P. Crenshaw
(74) *Attorney, Agent, or Firm*—Armstrong, Westerman & Hattori, LLP

(57) ABSTRACT

The present invention has an exemplified object to provide a recording device and method each having a good mechanical property, such as an endurance, enough to realize a high-speed and high-quality recording. In the recording device, an absorptive part is formed by a surface treatment of a feed belt. In the triboelectric series, a difference in charged amount between the absorptive part and a printing paper is made large, and an electric reaction between an ink drop and the printing paper is prevented.

10 Claims, 6 Drawing Sheets

RECORDING DEVICE AND METHOD, AND FEEDER

BACKGROUND OF THE INVENTION

The present invention relates generally to recording devices which realizes recording by adhering a recording material (liquid such as ink or particles/powder such as toner) to a recorded medium (for example, such as a printing paper or OHP film), and more particularly to a surface treatment of a feed belt which carries a recorded medium in the recording device.

The present invention is suitable for inkjet printers and electrophotographic (such as laser) recording devices that may provide high-speed and high-quality printing. The "inkjet printer" as used herein, means a non-impact printer (which does not use a ink ribbon and) that jets an ink drop from a nozzle onto a printing paper. The "electrophotographic recording device", as used herein, means a non-impact printer that realizes recording by adhering toner to a printing paper.

Inkjet printers, compatible with both monochromatic and multicolor printings and sold at a reasonable price, have become one of the most attractive small printers, superseding other types of printers, such as serial printers which print each letter, line printers which print each line, and page printers which print each page.

The inkjet printer is expected to provide a high-speed printing and high-quality image formation. These purposes necessitate the high-speed feeding and prevention of bending of a printing paper, in addition to control over the ink-drop amount and concentration ejected from a print head (inkjet head), and the increased number of nozzles in the head for high resolution. For example, the roller feeding at both ends of a printing paper would often slightly distort the paper due to vibration during the feeding and a difference in friction force between each roller and the paper. The slack paper would dislocate landing points of ink drops and thereby deteriorate the image quality, as well as besmear the paper surface with ink when contacting the nozzle. In particular, the increased number of nozzles makes large the head, and increasingly narrow an interval (or gap) between the head and printing paper near the nozzle, leading to the above disadvantages.

Accordingly, in place of using a roller to feed a printing paper, an absorptive belt that electrostatically absorbs one side of and feeds a printing paper using the triboelectric series has been proposed so as to feed the printing paper at a high speed while preventing the paper from bending. The "triboelectric series", as used herein, is an arrangement of (electrostatically charged things or) things which store electrostatic charges generated along with a dynamic action such as a contact or separation between things, as seen in two things rubbed together, from those tending to get charged into plus to those tending to get charged into minus. The triboelectric series may indicate which of two things rubbed together has the plus or the minus polarity, and employ the work function (eV) for quantitative representation.

Mechanically strong and heatproof materials, such as polyethylene terephthalate (PET), polyimide, polyamide, poly vinylidene fluoride (PVDF) etc., have been proposed for a feed belt. Among them, part of PVDF has been reduced to practice as absorptive belt materials. In the triboelectric series, PVDF tends to get charged into the minus side relative to a printing paper (for example, a regular paper made of cellulose as a basic component) and the printing paper tends to get charged into the plus side. Therefore, when both members are charged properly, the feed belt serves to absorb the paper.

Even an ink drop used tends to get charged into the plus or minus polarity. Only considering the electrostatic absorption matching between a printing paper and feed belt might equalize a polarity of an ink drop with that of a printing paper, and cause an electric reaction between each other. Then, a flying ink drop subject to the electrostatic force would yield a dislocated landing point, and deteriorate the image quality. Therefore, the instant inventors have discovered that it is also necessary to consider the triboelectric series of an ink drop in addition to those of a printing paper and feed belt for both high-speed feeding and high-quality recording. For example, when an absorptive belt is made of PVDF, the printing paper will get charged into plus at its belt side and minus at its ink side (opposite side to the belt side). As a result, the ink drop charged into the minus side would react on the surface of the printing paper.

In particular, this reaction will dramatically deteriorate the image quality in such a recording part as an inkjet or a toner jet printer which adheres a recording material to a recorded medium spaced apart from the head.

The instant inventors have also discovered that a successful consecutive use of a feed belt would require the feed belt to be made of a material having the proper mechanical property such as a good mechanical strength, less distortion, and easy to keep clean. Nevertheless, those material which meet this mechanical property requirement do not always satisfy the above triboelectric relationship requirement, and it is not easy to elect a material which meet these two requirements.

Moreover, even a feed belt that meets the mechanical property and triboelectric relationship requirements might provide a week absorptive force insufficient to feed a recorded medium at a high speed. Thus, in some cases, in addition to the above two requirements, it is also necessary to select a material which may make large the electrostatic absorptive force between the feed belt and recorded medium. As a result, a proper selection would become increasingly difficult.

BRIEF SUMMARY OF THE INVENTION

Therefore, it is an exemplified general object of the present invention to provide a novel and useful recording device and method, and feeder in which the above disadvantages are eliminated.

Another exemplified and more specific object of the present invention is to provide a recording device and method, and feeder each having a good mechanical property, such as an endurance, enough to realize a high-speed and high-quality recording.

In order to achieve the above objects, a recording device of the present invention comprises a recording part which adheres a recording material to a recorded medium, a feed belt which may electrostatically absorb and feed the recorded medium, and a drive part which drives the feed belt so as to feed the recorded medium, wherein in a triboelectric series the feed belt tends to get charged into a side of a first polarity selected from plus and minus relative to the recorded medium, and the recording material tends to get charged into a side of a second polarity opposite to the first polarity. According to this recording device, when the feed belt is charged into a plus side relative to the recorded medium, a surface of the recorded medium opposite to the feed belt gets charged into a minus side and a surface of the recorded medium at the side of the recording material gets charged into a plus side, getting along with the recording material which tends to get charged into a minus side. Inversely, when the feed belt is charged into a minus side relative to the recorded medium, a surface of the recorded medium opposite to the feed belt gets charged into a plus side and a surface of the recorded medium at the side of the recording material gets charged into a minus side, getting along with the recording material which tends to get charged into a plus side. At all events, the feed belt and recorded medium get charged into opposite polarities and absorb each other electrostatically, while the recorded medium and recording material may become in opposite polarities preventing a reaction.

A recording device of the present invention comprises a recording part which adheres a recording material to a recorded medium, an absorptive part which may electrostatically absorb the recorded medium, a feed belt connected to the absorptive part, the feed belt feeding the recorded medium via the absorptive part, and a drive part which drives the feed belt, wherein in a triboelectric series the absorptive part tends to get charged into a side of a first polarity selected from plus and minus relative to the recorded medium, and the recording material tends to get charged into a side of a second polarity opposite to the first polarity. According to this recording device, when the absorptive part is charged into a plus side relative to the recorded medium, a surface of the recorded medium opposite to the absorptive part gets charged into a minus side and a surface of the recorded medium at the side of the recording material gets charged into a plus side, getting along with the recording material which tends to get charged into a minus side. Inversely, when the absorptive part is charged into a minus side relative to the recorded medium, a surface of the recorded medium opposite to the absorptive part gets charged into a plus side and a surface of the recorded medium at the side of the recording material gets charged into a minus side, getting along with the recording material which tends to get charged into a plus side. At all events, the absorptive part and recorded medium get charged into opposite polarities and absorb each other electrostatically, while the recorded medium and recording material may become in opposite polarities preventing a reaction.

A recording method of the present invention comprises the steps of forming an absorptive part on a substrate of a feed belt which may feed a recorded medium by a surface treatment of the substrate so that the absorptive part tends to get charged, in a triboelectric series, into a side of a first polarity selected from plus and minus relative to the recorded medium and relative to the substrate, feeding the recorded medium by driving the feed belt while electrostatically absorbing the recorded medium onto the absorptive part, and adhering to the recorded medium a recording material which tends to get charged into a side of a second polarity opposite to the first polarity. This recording method thus forms the absorptive part by a surface treatment of the substrate of the feed belt. Where a material having a good mechanical property is selected for the substrate of the feed belt, the surface treatment may conveniently control a change of the triboelectric series. The surface treatment may enhance the absorption between the recorded medium and absorptive part using the triboelectric series.

A feeder of the present invention comprises a feed belt which may electrostatically absorb and feed a paper-like member, and a drive part which drives the feed belt so as to feed the paper-like member, wherein the feed belt includes a substrate, and an absorptive part which is formed by a surface treatment of the substrate and may electrostatically absorb the paper-like member, and wherein in a triboelectric series the paper-like member tends to get charged into a side of a first polarity selected from plus and minus relative to the absorptive part and the substrate tends to get charged into the side of the first polarity relative to the absorptive part. According to the feeder, where a material having a good mechanical property is selected for the substrate of the feed belt, the surface treatment may conveniently control a change of the triboelectric series. The surface treatment may enhance the absorption between the paper-like member and absorptive part using the triboelectric series.

Other objects and further features of the present invention will become readily apparent from the following description of the embodiments with reference to accompanying drawings.

DETAILED DESCRIPTION OF INVENTION

Figure 1:
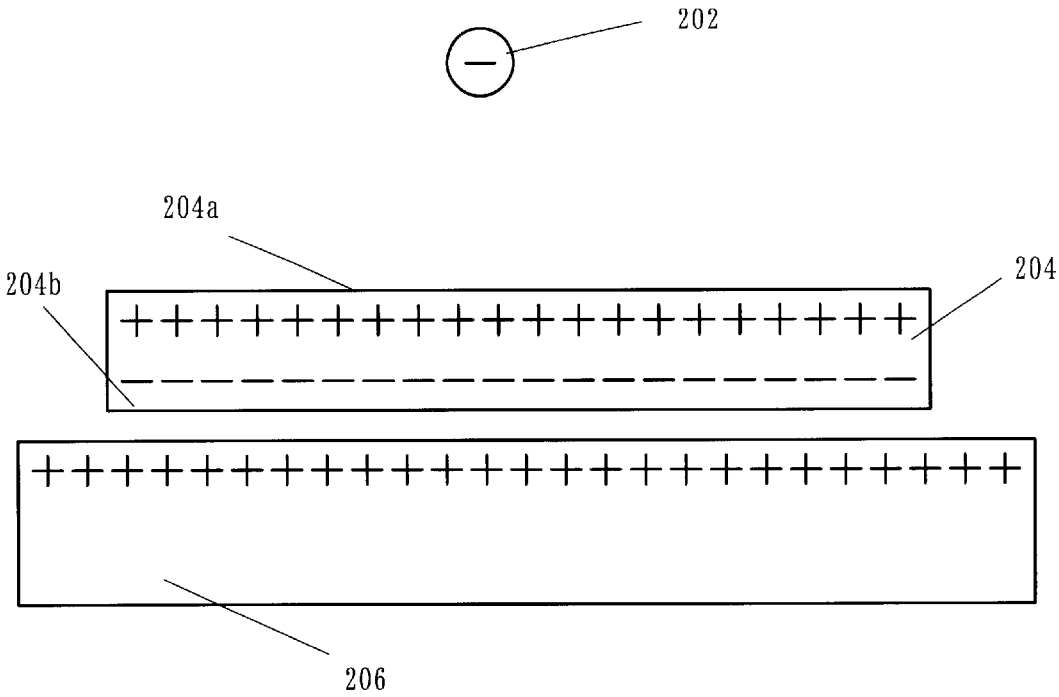
FIG. 1 is a typical view for explaining a triboelectric relationship among an ink drop as a recording material, a printing paper as a recorded medium, and a feed belt applicable to the recording device of the present invention.
Figure 2:
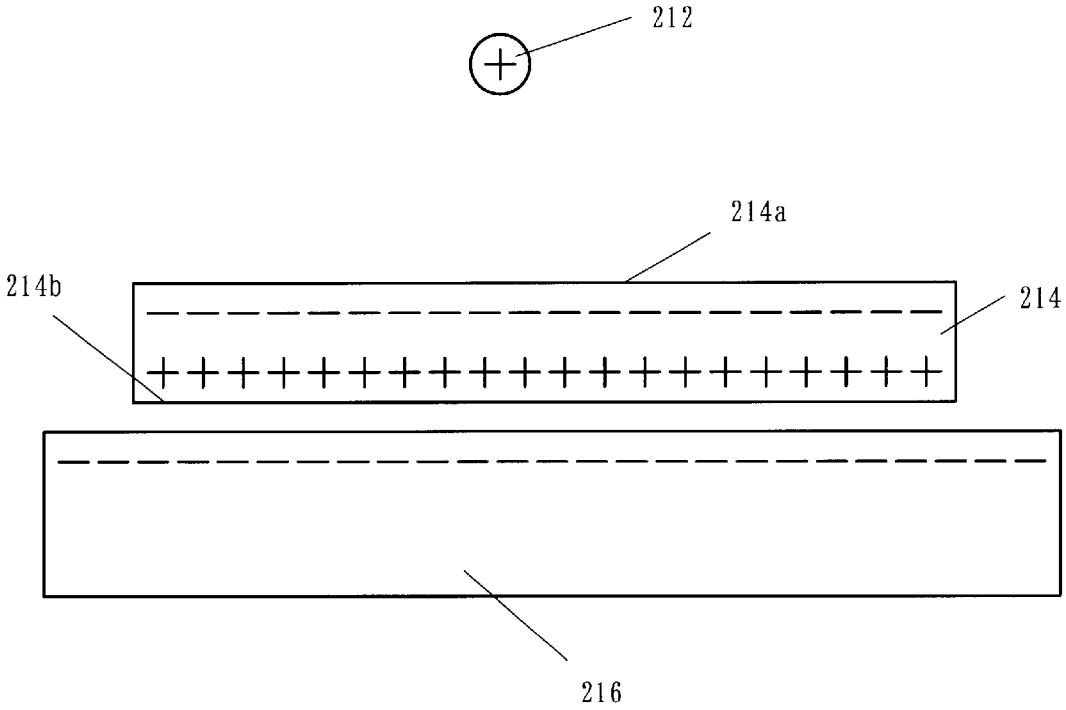
FIG. 2 is another typical view for explaining a triboelectric relationship among an ink drop as a recording material, a printing paper as a recorded medium, and a feed belt applicable to the recording device of the present invention.

With reference to the accompanying drawings, a description will now be given of a triboelectric relationship among a recording material, a recorded medium, and a feed belt for use with the recording device of the present invention. With reference to FIGS. 1 and 2, a description will be given of an exemplified principle of the present invention. Those elements which are designated by the same reference numerals are corresponding elements, and a duplicate description will be omitted. Hereupon, FIGS. 1 and 2 are each a typical view for explaining a triboelectric relationship among an ink drop as a recording material, a printing paper as a recorded medium, and a feed belt applicable to the recording device of the present invention. In FIGS. 1 and 2, a size and a position of each component are somewhat exaggerated for description and illustration purposes.

Referring to FIG. 1, materials for printing paper 204 and feed belt 206 are so selected that their triboelectric series (arranged from minus to plus) may meet (printing paper 204)<(feed belt 206). More particularly, in the triboelectric series of the printing paper 204 and feed belt 206, the feed belt 206 tends to get charged into the plus side relative to the printing paper 204. Therefore, surface 204*b* of the printing paper 204 that faces the feed belt 206 is charged into the minus side, and the feed belt 206 into the plus side. As a result of that the surface 204*b* of the printing paper 204 is charged into the minus side, surface 204*a* of the printing paper 204 at the side of ink drop 202 is charged into the plus side. Then, a material which tends to get charged into the minus side as an opposite polarity is selected for the ink drop 202.

Similarly, referring to FIG. 2, materials for printing paper 214 and feed belt 16 are so selected that their triboelectric series (arranged from minus to plus) may (feed belt 216)≦(printing paper 214). More particularly, in the triboelectric series of the printing paper 214 and feed belt 216, the feed belt 216 tends to get charged into the minus side relative to the printing paper 214. Therefore, surface 214*b* of the printing paper 214 that faces the feed belt 216 is charged into the plus side, and the feed belt 216 into the minus side. As a result of that the surface 214*b* of the printing paper 214 is charged into the plus side, surface 214*a* of the printing paper 214 at the side of ink drop 212 is charged into the minus side. Then, a material which tends to get charged into the plus side as an opposite polarity is selected for the ink drop 212.

As shown in FIGS. 1 and 2, proper selection of materials for the recording material (202, 212), recorded medium (204, 214), and feed belt (206, 216) would charge the feed belt and recorded medium into reverse polarities that realize an electrostatic absorption between them, as well as charge the recorded medium and the recording material into reverse polarities that prevent an electric reaction between them. A conventional structure has addressed only the electrostatic absorption between the recorded member and feed belt, and often used the ink drop 212 instead of the ink drop 202 in FIG. 1 or the ink drop 202 instead of the ink drop 212 in FIG. 2. As a result, the recorded medium and recording material become in the same polarity, react each other, dislocate a landing point of the recording material from a desired point, and deteriorate the image quality. The present invention eliminates these problems. Charging into reverse polarities of and the electrostatic absorption between the feed belt and recorded medium would prevent looseness of the recorded medium and enable the feed belt to feed the recorded medium at a high speed. As a result, the triboelectric structure of the present invention prevents the looseness of a recorded medium that deteriorates the image quality, and ensures the high-speed feeding and recording of the recorded medium.

Figure 3:
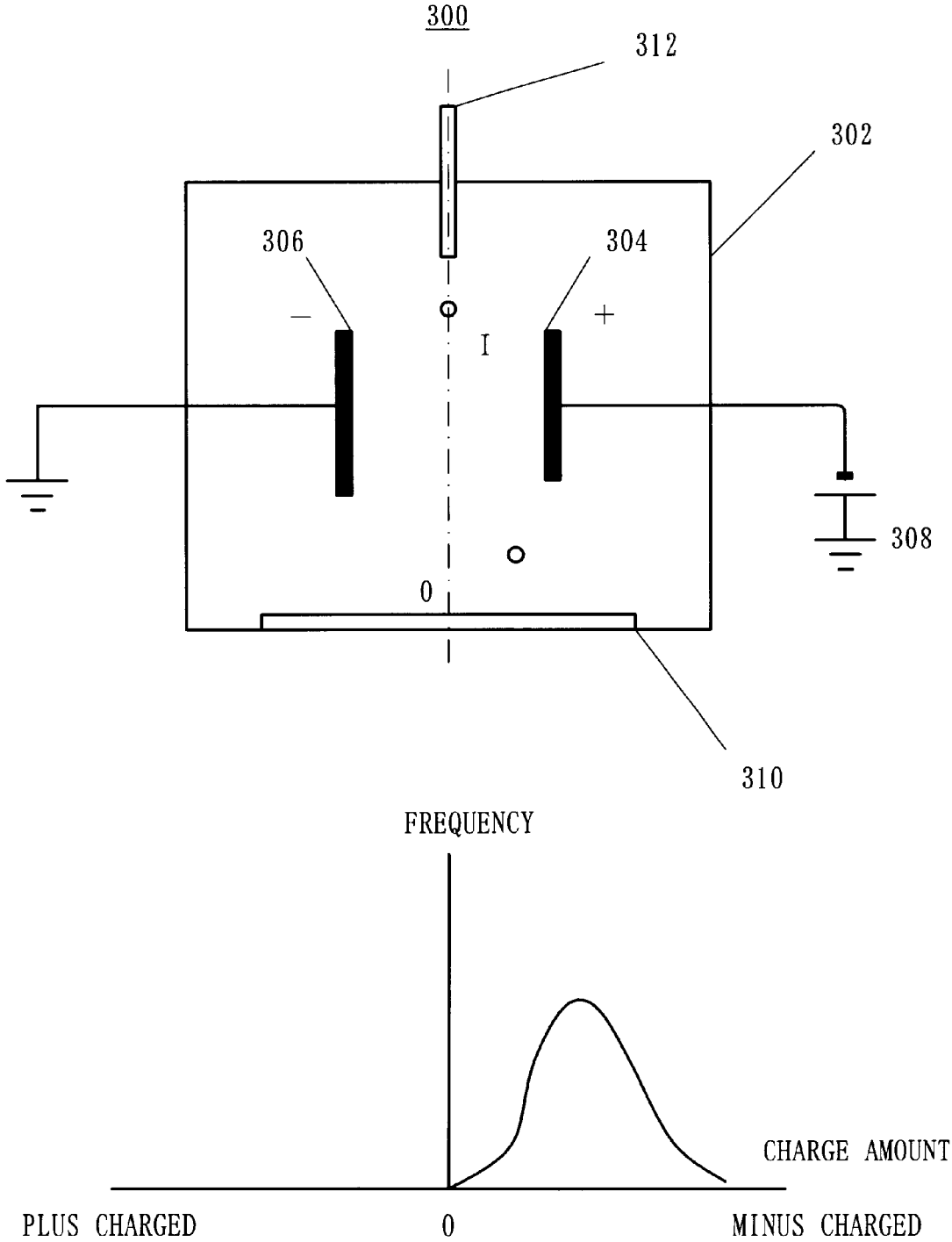
FIG. 3 is a view for explaining a measuring device of the charge amount of an ink drop and an evaluation method of a measurement result.

A description will now be given of a method of detecting a polarity into which an ink drop, such as the ink drops 202 and 212, tends to get charged, with reference to FIG. 3. Here, FIG. 3 is a view for explaining a measuring device of the charge amount of an ink drop and an evaluation method of a measurement result. Device 300 which measures an ink-drop charge amount includes, as shown in a top view in FIG. 3, a pair of electrodes 304 and 306, power source 308, and recording paper 310 in housing 302. The charge measuring device 300 detects which electrode attracts ink drop I naturally dropping from jet device 312 above a center line between the electrodes 304 and 306. The ink drop I is not charged when dropping vertically. It is charged into the plus side when attracted by the plus electrode 304 or the minus side when attracted by the minus electrode 306. A bottom view in FIG. 3 is a graph used to evaluate the charge amount based on landing positions of ink drops drawn on the recording paper 310. As understood from the graph at the bottom of FIG. 3, the exemplified ink drop shown in FIG. 3 is charged into the minus side because it is attracted by the plus electrode 304. Therefore, it is evaluated to belong to the ink drop 202 shown in FIG. 1.

Figure 4:
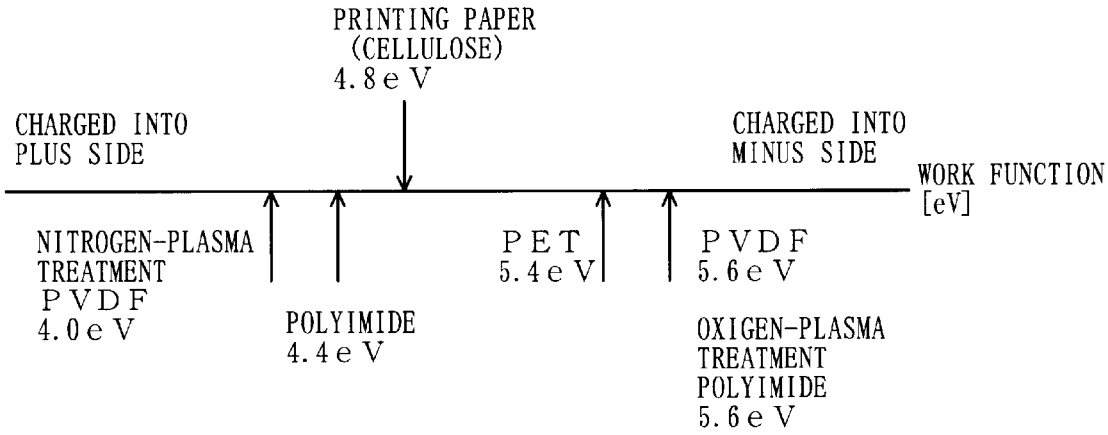
FIG. 4 is a triboelectric series of materials which may be basic components for recorded medium and feed belt.

With reference to FIG. 4., a description will now be given of concrete materials for the printing papers 204, 214 and feed belts 206, 216 shown in FIGS. 1 and 2. FIG. 4 is a triboelectric series of polymer materials that may constitute basic components for recorded medium and feed belt. If it is assumed that the printing papers 204 and 214 are made of the printing paper (cellulose) shown in FIG. 3, the feed belt 206 may select, for example, polyimide, and the feed belt 216 may select, for example, polyethylene terephthalate (PET) and PVDF. It is noted that these materials are selected when the triboelectric relationship between the printing paper and feed belt is considered. Indeed, it is preferable to review whether the actually selected material for the feed belt has the mechanical property suitable for the applied recording device, as described later.

Figure 5:
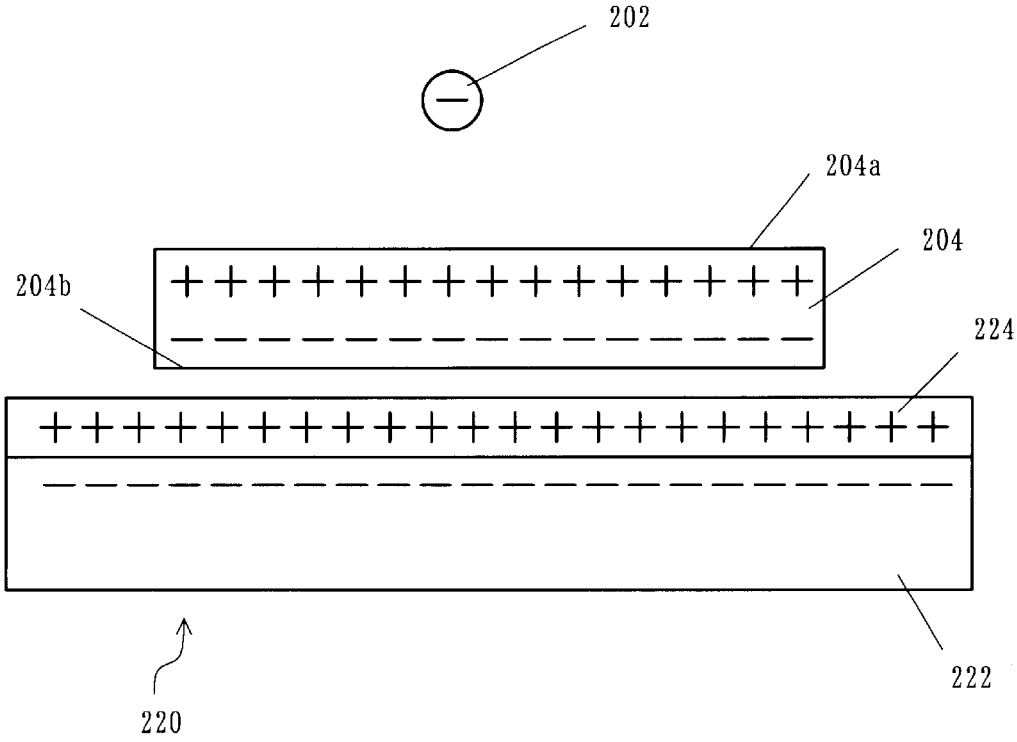
FIG. 5 is a variation of FIG. 1, which is a typical view for explaining a triboelectric relationship among an ink drop as a recording material, a printing paper as a recorded medium, and an absorptive part and substrate in a feed belt applicable to the recording device of the present invention.
Figure 6:
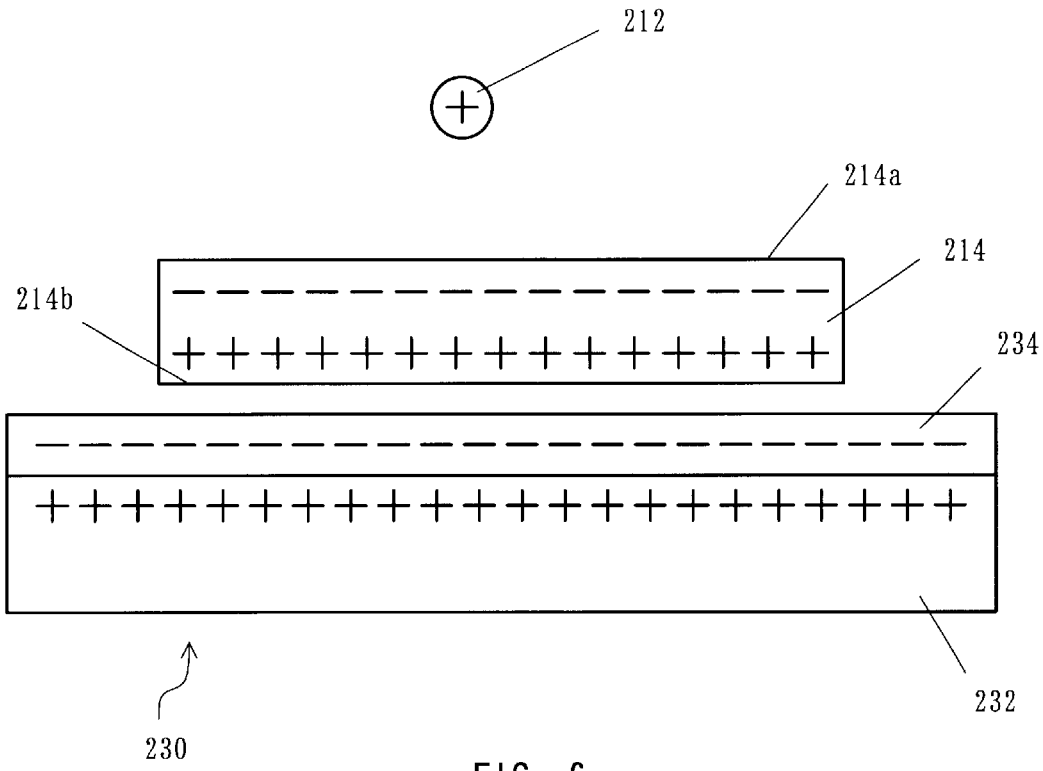
FIG. 6 is a variation of FIG. 2, and which is another typical view for explaining a triboelectric relationship among an ink drop as a recording material, a printing paper as a recorded medium, and an absorptive part and substrate in a feed belt applicable to the recording device of the present invention.

The instant inventors have discovered that a correction of the triboelectric series using the surface treatment for the feed belt would be preferable to at least two reasons below. Firstly, the corrected triboelectric series of the feed belt would prevent the electric reaction between the recording material and recorded medium while maintaining the mechanical property of the feed belt. Secondly, the corrected triboelectric series of the feed belt would enhance the electrostatic absorptive force between the feed belt and the recorded medium. A description will now be given of these reasons with reference to FIGS. 5 and 6. FIGS. 5 and 6 are modifications of FIGS. 1 and 2, which are typical views for explaining a triboelectric relationship among the ink drop as a recording material, a printing paper as a recorded medium, an absorptive part and substrate of the feed belt.

In connection with the first reason, a successful consecutive use of a feed belt would require the feed belt to be made of a material having a predetermined mechanical property such as a good mechanical strength, less distortion, and easy to keep clean. Even when a material having the triboelectric relationship shown in FIG. 1 are used for the feed belt 206, the material having the mechanical property lower than the desired one would break or disfigure the belt, which is inappropriate to the recording device of the present invention. On the other hand, those which have a good mechanical property but do not satisfy the triboelectric relationship requirement would result in the electric reaction between the recording material and recorded medium, deteriorating the image quality. For example, it has been ascertained that PVDF shown in FIG. 4 reveals a mechanical property suitable for inkjet printer 1 as one aspect of the recording device of the present invention, but PVDF does not show the triboelectric relationship shown in FIG. 1.

This problem may be eliminated by feed belts 220 and 230 shown in FIGS. 5 and 6. The feed belt 220 shown in FIG. 5 includes substrate 222, and absorptive part 224 that is formed by the surface treatment of the substrate 222. The feed belt 230 shown in FIG. 6 includes substrate 232, and absorptive part 234 that is formed by the surface treatment of the substrate 232. For example, when PVDF is used for the substrate 222 and the absorptive part 224 is formed by the surface treatment of the substrate 222 using a plasma treatment in FIG. 5, PVDF after the plasma treatment is charged into the plus side relative to the printing paper as shown in FIG. 4. On the other hand, when polyimide is used for the substrate 232 and the absorptive part 234 is formed by the surface treatment of the substrate 232 using a plasma treatment in FIG. 6, polyimide after the plasma treatment is charged into the minus side relative to the printing paper as shown in FIG. 4. The plasma treatment is merely an exemplified surface treatment, and the surface treatment is not limited to it. Thus, another exemplified aspect of the present invention may form, using the surface treatment, a triboelectric relationship suitable for ink drops used while maintaining the mechanical property of the feed belt. In this case, it would be understood that the triboelectric series of the substrate, absorptive part, and recorded medium would be arranged in the order of the substrate, the recorded medium, and the absorptive part, or the absorptive part, the recorded medium, and the substrate. The substrate does not meet the triboelectric relationship shown in FIGS. 1 and 2, and the substrate and absorptive part are in reverse polarities viewed from the recorded medium in the triboelectric series.

In connection with the second reason, while a feed belt will be increasingly required to feed a recorded medium at a higher speed, an electrostatic absorptive force becomes large between the feed belt and recorded medium as the difference between their charge amounts becomes large. Therefore, it would be understood that for example, in FIG. 4, a feed belt made of PVDF would be able to feed a printing paper at a higher speed than that using PET. In such a case, it is preferable to form, by the surface treatment of the substrate of the feed belt, an absorptive part whose work function is greatly different from that of the recorded medium. In this case, it would be understood that the triboelectric series of the substrate, absorptive part, and recorded medium would be arranged in the order of the recorded medium, the substrate and the absorptive part or the absorptive part, the substrate and the recorded medium. In other words, the substrate meets the triboelectric relationship shown in FIGS. 1 or 2, and is in the same polarity side as the absorptive part viewed from the recorded medium in the triboelectric series but the absorptive part is separated from the recorded medium farther than the substrate.

The surface treatment might be required for both of the first and second reasons. For example, as shown in FIG. 4, polyimide that has experienced a plasma treatment not only reverses its polarity from the plus side to the minus side, but also increases after the plasma treatment a difference in charge amount from a printing paper, enhancing the electrostatic absorptive force with the printing paper. In any event, the feed belt may obtain the desired triboelectric relationship while maintaining its mechanical property in the above first and second reasons. Needless to say, instead of forming the absorptive part by the surface treatment of the substrate of the feed belt, the absorptive part may be formed as an independent member (for example, by making a two-tier structure of feed belt).

Next follows a description of a surface treatment method of a feed belt. A surface treatment that changes the triboelectric series includes chemical and/or physical treatments. The chemical treatment includes a drench treatment in a solvent, plasma and optical treatments. The physical treatment includes a surface laser treatment. These treatments may be roughly classified into a group that changes the triboelectric series into the plus side and a group that changes the triboelectric series into the minus side. In order to change the triboelectric series into the minus side, the solvent may use, for example, phosphoric acid. The plasma treatment, optical treatment using the ultraviolet light radiation, and surface laser treatment are performed under the oxygen gas atmosphere. On the other hand, in order to change the triboelectric series into the plus side, the solvent may use, for example, an amino solvent (such as ammonia solution). The plasma treatment, optical CVD treatment using the ultraviolet light radiation, and surface laser treatment are performed under the nitrogen gas atmosphere.

Figure 7:
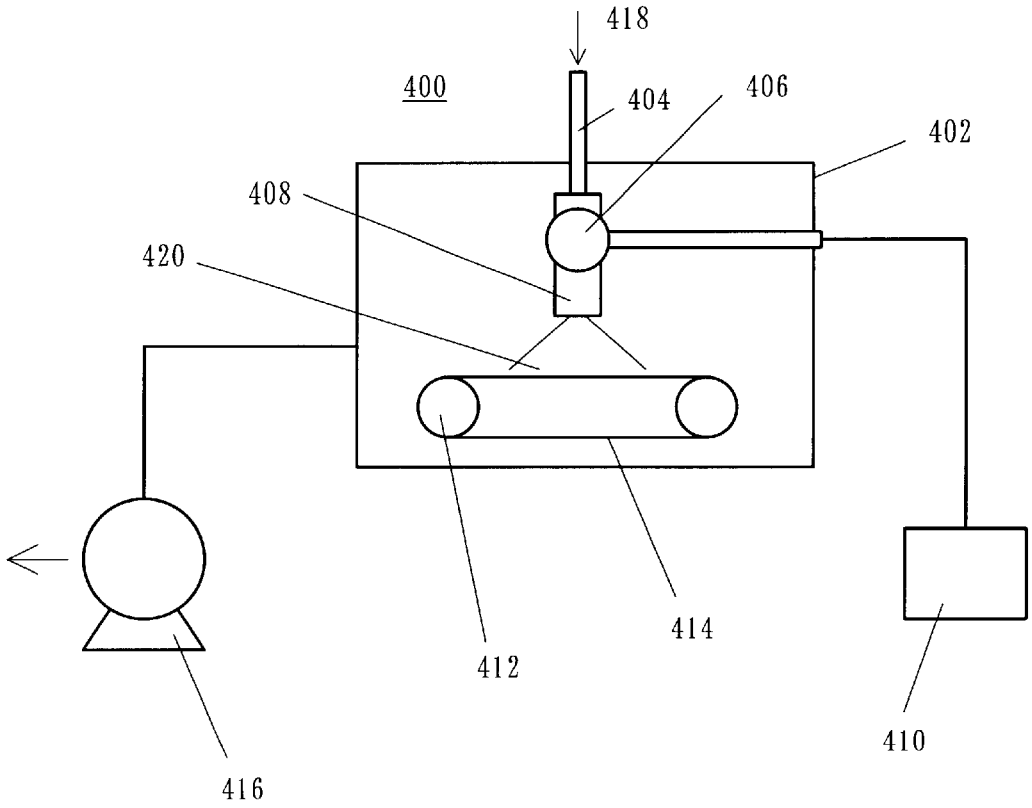
FIG. 7 is a schematic block diagram of a microwave plasma treatment for surface treatment on device.

A description will be given of a plasma treatment as a surface treatment with reference to FIG. 7. FIG. 7 is a schematic block diagram of microwave plasma treatment device 400 as a surface treatment device. The microwave plasma treatment device 400 makes reactive gas in a plasma state so as to change it into active radical ions, and performs a surface treatment by reacting the radical ions with the feed belt. The microwave plasma treatment device 400 includes vacuum (process) chamber 402, quartz tube 404, plasma generator 406, wave-introduction tube 408, microwave source 410, rollers 412, feed belt 414, and exhaust pomp 416. Nitrogen or oxygen gas is selected as the reactive gas 418 depending upon a polarity into which the feed belt 414 is made changed.

Side walls and bottom of the vacuum chamber 402 are made of a conductive member such as aluminum, and a high-vacuum pump (not shown) maintains the inside as a predetermined reduced pressure or vacuum close space. The quartz-pipe gas supply tube 404 is provided above the vacuum chamber 402, and the quartz tube 404 is flow-controlled by a gas supply path (not shown), and connected to a reactive gas source (not shown). Needless to say, an arrangement of the quartz tube 404 is not limited to the top of the vacuum chamber 402. The reactive gas may be blended with inert gas. The quartz tube 404 passes in the wave-introduction tube 408.

The microwave source 410 includes, for example, a magnetron which may usually generates 2.45 GHz microwave. A transmission mode of the microwave is then converted into TM, TE or TEM modes by a mode converter (not shown). FIG. 7 omits an isolator which absorbs a reflection wave which is the generated microwave returning to the magnetron, and an EH tuner or a stab tuner which provides a matching with a load side.

A pair of rollers 412 are provided in FIG. 7, but any number of rollers may be provided. The rollers 412 rotate the feed belt 414 so as to form a uniform thickness of an absorptive part on its substrate. FIG. 7 omits a mechanism for elevating and fixing the rollers 412 and feed belt 414. The exhaust pump 416 is comprised of a rotary pump, mechanical pump, and the like, and exhausts the vacuum chamber 402.

In operation, microwaves emitted from the microwave source 410 excite the gas in the quartz tube 404 via the plasma generator 406 that is connected to the wave-introduction tube 408 having the quarts tube 404 in its inside. The gas 420 excited in the quartz tube 404 diffuses in the vacuum chamber 402, and performs a surface treatment for the feed belt 414. When the nitrogen gas is used for the reactive gas, the feed belt 414 surface changes into the plus side. When the oxygen gas is used for the reactive gas, the feed belt 414 surface changes into the minus side.

In the plasma treatment, the watt value of the microwaves, the flow amount of the reactive gas, and the internal pressure of the vacuum chamber 402 would change the nitrogen or oxygen plasma amount generated. The excessively large plasma amount would deteriorate belt's strength disadvantageously. Accordingly, in the nitrogen plasma surface treatment, an increased amount of nitrogen atoms is 0.5–6 ATM %, more preferably 2–3 ATM % in the absorptive part of the feed belt 414. The increased amount of nitrogen atoms of 15–30 ATM % would deteriorate the feed belt 414 disadvantageously. In the oxygen plasma surface treatment, an increased amount of oxygen atoms is 1–20 ATM %, more preferably 5–10 ATM % in the absorptive part of the feed belt 414. The increased amount of nitrogen atoms of 20–30 ATM % would deteriorate the feed belt 414 disadvantageously.

Figure 8:
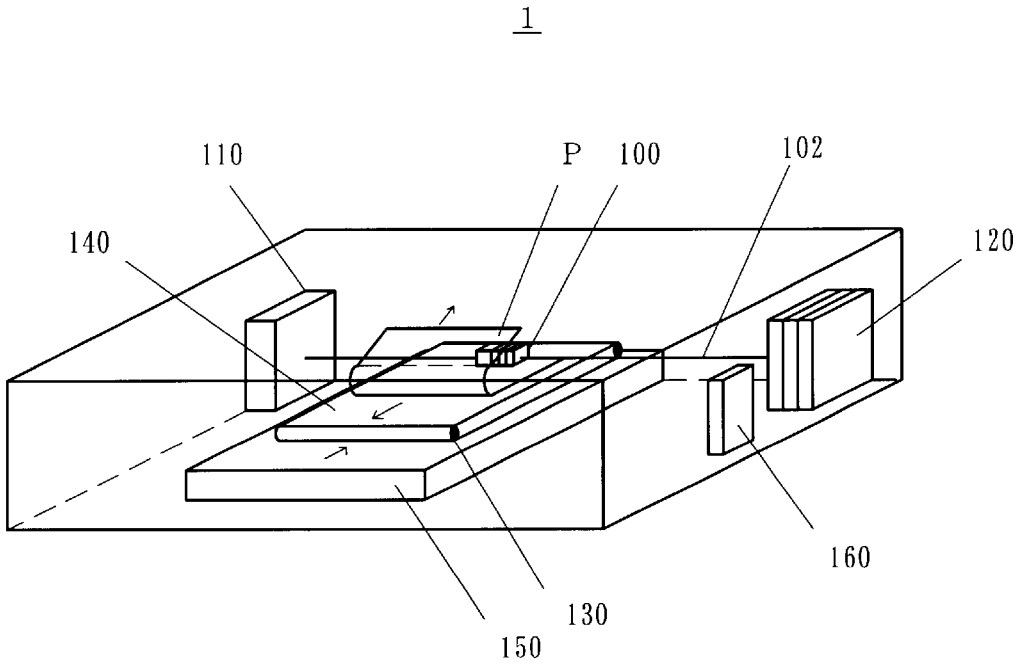
FIG. 8 is a schematic perspective view of an inkjet printer.
Figure 9:
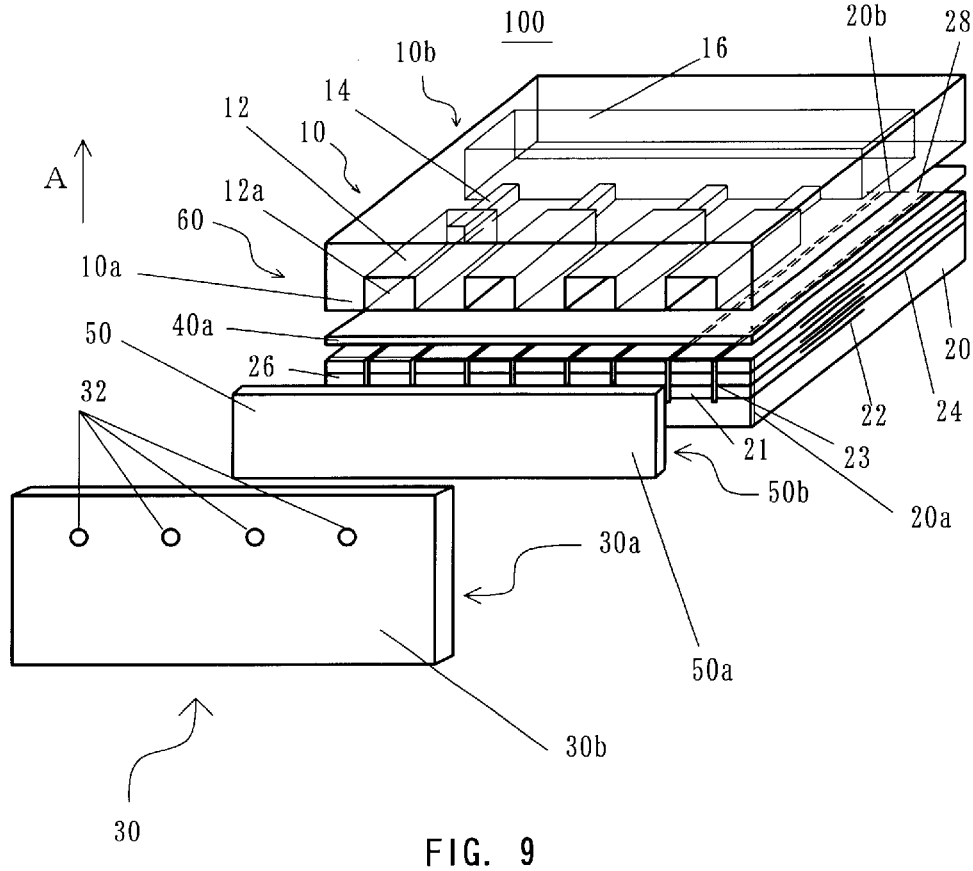
FIG. 9 is an exploded perspective view of an inkjet head applicable to the inkjet printer shown in FIG. 8.
Figure 10:
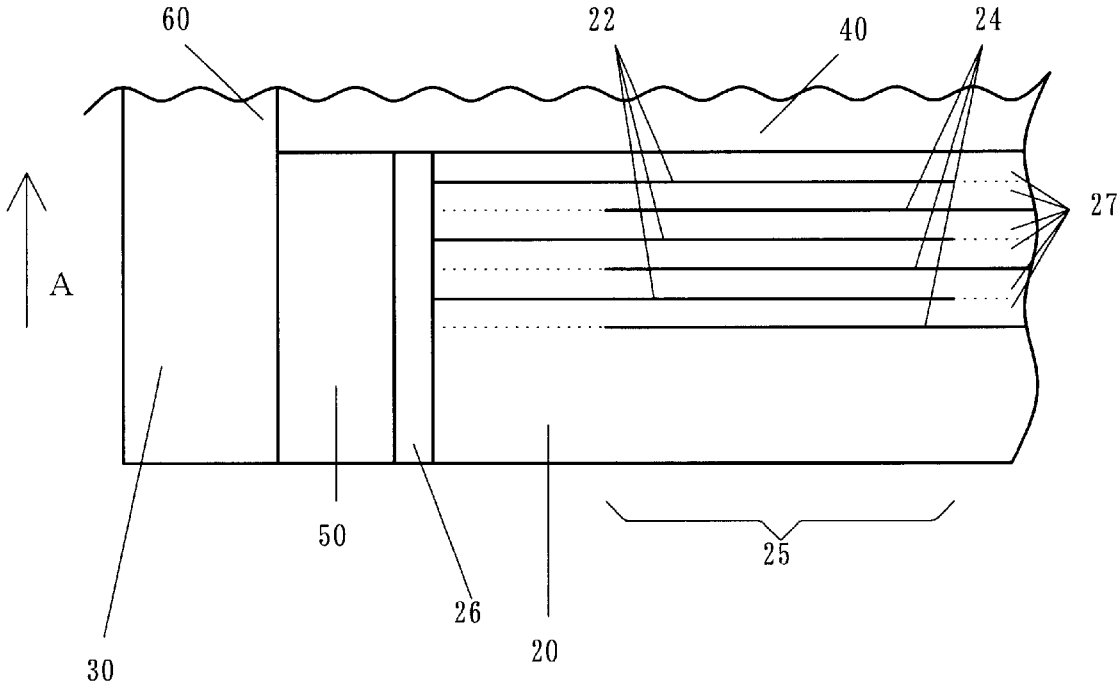
FIG. 10 is a partially enlarged side view of the inkjet head shown in FIG. 9.

With reference to FIGS. 8–10, a description will be given of color inkjet printer 1 of one aspect of the recording device according to the present invention. FIG. 8 is a schematic perspective view of inkjet printer 1. FIG. 9 is an exploded perspective view of inkjet head 100 applicable to the inkjet printer 1 shown in FIG. 8. FIG. 10 is a partially enlarged side view of the inkjet head 100 shown in FIG. 9.

Referring to FIG. 8, the exemplified color inkjet printer 1 of the present invention includes in a housing, inkjet head 100, black ink tank 110, color ink tank 120, feed rollers 130, feed belt 140, paper-supply cassette 150, and backup unit 160.

A description will be given of the inkjet head 100 with reference to FIGS. 8 through 10. The inkjet head 100 includes pressure-chamber plate 10, piezoelectric element 20, nozzle plate 30, resin film 40, and protective layer 50. The pressure-chamber plate 10, the resin film 40 and the protective layer 50 are aligned with each other at nozzle connection surface 60 which is a surface to which surface 30*a* of the nozzle plate 30 is connected. In other words, front surface 10*a* of the pressure-chamber plate 10, front surface 40*a* of the resin film 40, and front surface 50*a* of the protective layer 50 form the flat nozzle connection surface 60. The pressure-chamber plate 10 is adhered to resin film 40, for example, by urethane adhesives, acrylic adhesives, resist films, etc.

The pressure-chamber plate 10 has the desired number (four in FIG. 9 for description purposes) of pressure chambers 12 and ink introduction channels 14 and common ink chamber 16 in an approximately rectangular parallelepiped glass plate. Each pressure chamber 12 receives and accommodates ink, and jets the ink from a corresponding nozzle hole 32 connected to opening 12*a* as the internal pressure increases. The internal pressure changes as the piezoelectric block 21 just under the pressure chamber 12 deforms, as described later. The pressure chamber 12 is formed as an approximately rectangular parallelepiped space by a concave groove on the pressure-chamber plate 10 and elastically deformable resin film 40.

The common ink chamber 16 supplies ink to each pressure chamber 12 through the corresponding ink introduction channel 14. A bottom of the common ink chamber 16 is defined by resin film 40 so as to absorb sudden internal-pressure changes, and connected to an ink supply device (not shown) at side 10*b* of the pressure-chamber plate 10. The common ink chamber 16 supplies a necessary amount of ink to the pressure chamber 12 via the ink introduction channel 14 when the chamber 12 returns to the original state after the pressure chamber 12 contracts, receives pressure, and jets ink.

The resin film 40 defines part of the pressure chambers 12, the common ink chamber 16, and the ink introduction channels 14. The resin film 40 serves to transmit deformation of each piezoelectric block 21 which will be described later to the corresponding pressure chamber 12, and to prevent ink in the pressure chambers 12 from penetrating into the grooves 23 in the piezoelectric element 20. Although the resin film 40 is a member that forms one surface of the pressure chamber 12, it may be replaced with an elastic metal thin film.

The piezoelectric element 20 has a layered structure having a plurality of (four in FIG. 9 for description purposes) piezoelectric blocks 21 which are divided by parallel grooves 23 which extend from front surface 20*a* to rear surface 20*b*. Internal electrodes 22 and 24 are provided between layers in piezoelectric elements 21. The internal electrodes 22 are connected to external electrode 26, and the internal electrodes 24 are connected external electrode 28. FIG. 9 shows only one external electrode 28 for illustration purposes.

As shown in FIG. 10, active area 25 is a portion where the internal electrodes 22 and 24 overlap each other in direction A, and each piezoelectric block deforms in this active area 25. The length of each active area 25 is adjustable depending upon pressure to be applied to the pressure chamber 12. The active area 25 is spaced from the nozzle connection surface 60 by a predetermined distance, and thus does not affect adhesion between the piezoelectric element 20 and the protective layer 50 at the nozzle connection surface 60. The external electrode 26 is an electrode layer that is formed on an entire surface of the front surface 20*a* of the piezoelectric element 20 by a vacuum evaporation. The external electrode 26 is an electrode commonly used for all the piezoelectric blocks 21, and grounded. The external electrode 28 is provided on the rear surface 20*b* of the piezoelectric element 20, but is not formed on an entire surface of the rear surface 20*b*. It is independently formed on only a portion corresponding to each piezoelectric block 21. The external electrode 28 has the potential of zero unless electrified, but may apply positive voltage to the internal electrode 24 when electrified.

Due to such a structure, each piezoelectric block 21 of the piezoelectric element 20 does not deform when no voltage is applied to the external electrode 28, since both potentials of the internal electrodes 22 and 24 remain zero. On the other hand, when the voltage is applied from the external electrode 28, each piezoelectric block 21 may deform in the direction A (longitudinal direction) in FIG. 9, independent of the other piezoelectric blocks 21. In other words, the direction A is the polarization direction for the piezoelectric element 21. When the electrification to the external electrode 28 stops, that is, when the piezoelectric element 20 is discharged, the corresponding piezoelectric block 21 returns to the original state.

The protective layer 50 is a thermosetting epoxy adhesive member having an approximately rectangular parallelepiped shape with a predetermined thickness, and connected via surface 50*b* to the front surface 20*a* of the piezoelectric element 20 (external electrode 26). However, the materials for the protective layer 50 are not limited to this type. The protective layer 50 in the practical inkjet head 100 does not have a strict rectangular parallelepiped shape, and the connection between the protective layer 50 and piezoelectric element 20 is not clear by the external electrode 26 and surface 50*b*, as shown in FIGS. 9 and 10. The protective layer 50 partially penetrates into the grooves 23 in the piezoelectric element 20*b* before thermosetting.

It is preferable that the protective layer 50 is made of insulating materials so as to prevent short-circuiting of the internal electrodes 22 and 24.

Although the inkjet head 100 shown in FIG. 9 includes the protective layer 50. As described later, the protective layer 50 has various effects as described below, but it is optional to provide the protective layer 50.

The protective layer 50 spaces the piezoelectric element 20 from the nozzle connection surface 60. When ink leaks from the pressure chamber 12 and penetrates into the piezoelectric element 20, ink penetrates into the piezoelectric element 20 mainly through nozzle connection surface 60. However, the protective layer 50 spaces from the nozzle connection surface 60 the piezoelectric element which has been conventionally located at the nozzle connection surface 60, and prevents the ink from penetrating into the piezoelectric element 20 and short-circuiting the internal electrode 22 and 24. Then, the protective layer 50 shields the grooves 23. When ink leaks and penetrates into the piezoelectric element 20, the ink penetrates into the piezoelectric element 20 mainly from the grooves 23 through the nozzle connection surface 60 from the opening 12*a* of the pressure chamber 12. The protective layer 50 25 shields the grooves 23 from the nozzle connection surface 60, preventing ink from penetrating into the grooves 23 from the neighborhood of the front surface 20*a* of the piezoelectric element 20 and short-circuiting the internal electrodes 22 and 24. Furthermore, the protective layer 50 serves to protect the piezoelectric element 20 from a breakage in this polishing process for forming the nozzle connection part 20*a* in the inkjet-head manufacturing steps. As a result, the polishing process does not cause any exfoliation, crack, and chip-off of the piezoelectric element 20, or the external electrode 26 is never cut off. In addition, the pressure-chamber plate 10 is made of glass and is a relatively strong, realizing a high polishing speed, thereby shortening the polishing time down to about one-fifth in comparison with the conventional manufacturing method.

In operation, each external electrode 28 independently applies voltage to the internal electrode 24 of the piezoelectric block 21, and each piezoelectric block 21 independently deforms in the direction A in FIG. 9, bending the resin film 40 in the direction A and compressing corresponding pressure chamber 12. This compression results in jetting ink from the pressure chamber 12 through corresponding nozzle hole 32. Aqueous dye or paint ink is used for an ink drop, and usually have an ink drop viscosity of 1.0 to 10 at a room temperature. When electrification from the external electrode 28 stops, the resin film 40 and the piezoelectric block 21 return to the original states by discharging. At that time, the internal pressure of the pressure chamber 12 reduces and ink is replenished from the common ink chamber 16 to the pressure chamber 12 through the ink introduction channel 14.

Turning back to FIG. 8, the feed roller 130 is attached rotatably to a platen (not shown). In the recording operation, the platen is intermittently driven and rotated by a drive motor (not shown), thereby intermittently feeding printing paper P by a predetermined pitch in an arrow direction. More concretely, the printing paper P, which has been drawn from the paper-supply cassette 150 one by one, moves in an arrow direction along the bottom surface of the feed belt 140. Then, the printing paper P is inversed and moved in the arrow direction on the feed belt 140, passing under the inkjet head 100 and ultimately getting inversed again before ejected.

The feed belt 140 has a structure of one of the feed belt 206 shown in FIG. 1, the feed belt 216 shown in FIG. 2, the feed belt 220 shown in FIG. 5, and the feed belt 230 shown in FIG. 6. In the either structure, the printing paper P may be absorbed strongly onto the feed belt 140 and fed. For example, according to the experiments conducted by the instant inventors, the feed belt 230 shown in FIG. 6 in which polyimide is used for its substrate and experienced a surface treatment using Oxygen plasma, increases an absorptive force and reduces the dislocated feed amount down to about ½ to ¼ (or about 10–20 $\mu$m) in comparison with a case that does not use the surface treatment.

Guide rod 102 is provided above and parallel to the platen in the printer housing, and the carriage (not shown) is provided in a slidable manner above the guide rod 102. The carriage (not shown) is driven by a drive motor (not shown), thereby reciprocating (scanning) along the platen.

The carriage includes the above inkjet head 100. More specifically, the inkjet head 100 includes heads for monochromatic (i.e., black-color) and multicolor printing. The multicolor printing head may include three components. The monochromatic printing head receives ink from black color ink tank 110, while the multicolor printing head receives color ink tank(s) 120. The ink tank may be replaced with an ink cartridge. The black color ink tank 110 accommodates black color ink, while the color ink tank(s) 120 accommodate yellow ink, cyan ink, and magenta ink. Due to the higher frequency of the black color ink than that of other color ink, the black color ink tank 110 has capacity larger than the ink tank 120 for each color.

While the carriage reciprocates along the guide rod 102 or the platen, the monochromatic and multicolor printing heads are driven based on image data provided from the word processor, personal computer, etc., whereby predetermined letters and images on the recording paper P.

An ink drop jetted from the head has a wide variety of types. In general, the dye ink tends to get charged into the minus side, and the paint ink the plus side. Therefore, it is preferable that a surface of the printing paper P facing the dye ink gets charged into the plus side as shown in FIGS. 1 and 5. On the other hand, it is preferable that a surface of the printing paper P facing the paint ink gets charged into the minus side as shown in FIGS. 2 and 6. The inkjet printer 1 of the present invention thus selects materials for the feed belt 140 so that an ink drop may not electrically react on the printing paper P, and performs a surface treatment for the feed belt 140 if necessary. Thereby, the dislocated landing point of the ink drop becomes reduced down to around ½ through ¼ (below about ±5 through 10 $\mu$m) of the electric reaction case, and the high-quality printing is realized.

When the recording operation stops, the carriage returns to a home position where a nozzle maintenance mechanism (back-up unit) 160 is provided. The nozzle maintenance mechanism 160 includes a movable suction cap (not shown) and a suction pump (not shown) connected to this movable suction cap. The recording head is positioned at the home position, the suction cap is adhered to the nozzle plate in each recording head and absorbs nozzle in the nozzle plate by driving the suction pump, so as to prevent any clogging in the nozzle.

Figure 11:
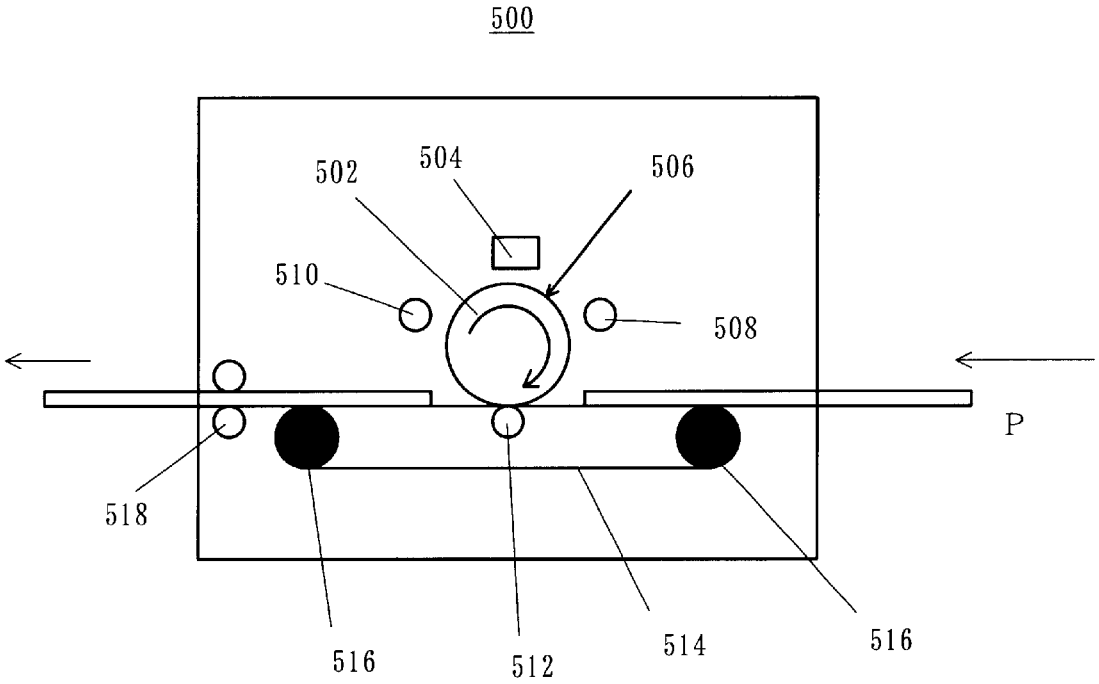
FIG. 11 is a sectional view of essential parts of the recording and feeding systems in the electrophotographic recording device.

The present invention is not limited to the inkjet printer 1, but broadly applicable to electrophotographic recording devices (such as a copier, facsimile machine, laser printer, etc.). A description will now be given of electrophotographic recording device 500 as a recording device of another aspect of the present invention with reference to FIG. 11. FIG. 11 is a sectional view of essential parts of the recording and feeding systems in the electrophotographic recording device 500. The electrophotographic recording device 500 includes photosensitive drum 502, charger 504, developer 508, cleaner 510, transfer unit 512, feed belt 514, feed rollers 516, and fixture roller 518. It further comprises a laser (not shown) that radiates laser light 506.

The photosensitive drum 502 includes a photosensitive dielectric layer on a rotatable drum conductive supporter, and uniformly charged by the charger 504. For example, the photosensitive body 502 is made, for example, of a function-separation type organic photosensitive body applied by a thickness of about 20 $\mu$m onto an aluminum drum, and has an outer diameter, for example, of 30 mm, rotating at a speed of 70 mm/s in an arrow direction. The charger 504 is a scorotron charger, and uniformly charges a surface of the photosensitive drum 502 by −600 V.

Exposure laser light 506 forms an image corresponding to the image on the photosensitive drum 502. The developer 508 receives toner from a toner cartridge (not shown) and develops the photosensitive drum 502 using toner. The cleaner 510 collects residual toner on the photosensitive drum 502 and, if necessary, returns it to the toner cartridge. The transfer unit 512 faces the photosensitive drum 502 via the printing paper P. The transfer unit 512 employs a known transfer unit using a corona (discharge) wire or conductive roller. It flows a current (which is referred to as "transfer current") from the corona wire to the photosensitive drum 502 and absorbs a toner image formed on the photosensitive drum 502.

The feed belt 514 has a structure of one of the feed belt 206 shown in FIG. 1, the feed belt 216 shown in FIG. 2, the feed belt 220 shown in FIG. 5, and the feed belt 230 shown in FIG. 6. Any of these structures may enable the printing paper P to be strongly absorbed onto and fed by the feed belt 514. The feed rollers 516, which are driven by a motor (not shown), drives and rotates the feed belt 514. The fixture roller 518 fixes toner on the printing paper P using heat and pressure.

In operation, the exposure laser light 506 is radiated onto the photosensitive drum 502 which has been uniformly charged by the charger 510. Then, the exposure by the laser light 506 extinguishes the uniform charges on the photosensitive drum 502 at a portion corresponding to the image, thereby forming a latent image. The developer 508 subsequently develops the latent image. Toner as charge particles (or powder) is attracted electrostatically onto a surface of the photosensitive drum 502 and consequently the latent image becomes a toner image on the photosensitive drum 502. The toner image is transferred to the printing paper P that is sent by the feed belt 514 at a proper timing to the transfer unit 512. In other words, when the printing paper P reaches the transfer position, the transfer unit 512 applies voltage to the corona wire at a surface of the printing paper P opposite to the photosensitive drum 502. As a consequence, the toner image on the surface of the photosensitive drum 502 is absorbed and adhered onto the printing paper P, and transferred to the printing paper P. The residual toner on the photosensitive drum 502 is collected by the cleaner 510. Then, the printing paper P is ejected to the outside of the device 500 after passing through and fixed by the fixture roller 518.

In this way, the electrophotographic recording device 500 employs fine charged particles called toner. It would be understood that since ink drops discussed in connection with FIGS. 1, 2, 5 and 6 may be replaced with toner similarly, the electrophotographic recording device 500 of the present invention may also obtain the same effects as those of the aforementioned inkjet printer 1 by properly selecting a structure of the feed unit 514.

Further, the present invention is not limited to these preferred embodiments, but various variations and modifications may be made without departing from the scope of the present invention. For example, the feed belt of the present invention is not exclusively used to feed a recorded medium, but may be used to use a paper-bill, for example.

As discussed, the present invention may provide a recording device and method, and feeder each having a good mechanical property, such as an endurance, enough to realize a high-speed and high-quality recording.

What is claimed is:

1. A recording device comprising:

a recording part which applies onto a recorded medium a recording material that gets charged into a first polarity selected from plus and minus;

a feed belt which electrostatically absorbs and feeds the recorded medium, said feed belt and said recorded medium being in a triboelectric series such that said feed belt gets charged into a second polarity opposite to the first polarity in a triboelectric series when said recorded medium is fed by driving said feed belt.

2. A recording device according to claim 1, wherein said feed belt includes a substrate and an absorptive part that is formed by a surface treatment of the substrate, wherein the absorptive part absorbs the recorded medium electrostatically, and wherein in the triboelectric series the substrate and the absorptive part tend to get charged into the side of the first polarity relative to the recorded medium, and the absorptive part tends to get charged into the side of the first polarity relative to the substrate.

3. A recording device comprising:

a recording part which applies onto a recorded medium a recording material that gets charged into a first polarity selected from plus and minus;

an absorptive part which electrostatically absorbs the recorded medium, said absorptive part and said recorded medium being in a triboelectric series such that said absorptive part gets charged into a second polarity opposite to the first polarity in a triboelectric series when said recorded medium is absorbed onto said absorptive part; and a feed belt connected to said absorptive part, said feed belt feeding the recorded medium via said absorptive part.

4. A recording device according to claim 3, wherein said feed belt includes a substrate that forms said absorptive part by a surface treatment, wherein the substrate tends to get charged into the side of the second polarity relative to the recorded medium in the triboelectric series.

5. A recording method comprising the steps of:

forming an absorptive part on a substrate of a feed belt by a surface treatment of the substrate so that the substrate gets charged, in a triboelectric series, into a first polarity selected from plus and minus and the absorptive part gets charged, in a triboelectric series, into a second polarity opposite to the first polarity;

feeding a recorded medium by driving the feed belt while electrostatically absorbing the recorded medium onto the absorptive part, said absorptive part and said recorded medium being in a triboelectric series such that said absorptive part gets charged into a second polarity opposite to the first polarity in a triboelectric series when said recorded medium is fed by driving said feed belt; and applying onto the recorded medium a recording material which gets charged into the first polarity.

6. A method according to claim 5, wherein said absorptive part forming step drenches the substrate in a solvent.

7. A method according to claim 5, wherein said absorptive part forming step radiates ultraviolet light onto the substrate under a predetermined atmosphere.

8. A method according to claim 5, wherein said absorptive part forming step radiates laser onto the substrate under a predetermined atmosphere.

9. A method according to claim 5, wherein said absorptive part forming step performs a plasma treatment for the substrate under a predetermined atmosphere.

10. A feeder comprising:

a feed belt which electrostatically absorbs and feeds a paper-like member; and a drive part which drives the feed belt so as to feed the paper-like member which gets charged into a side of a first polarity selected from plus and minus in a triboelectric series, wherein said feed belt includes:

a substrate which gets charged into the side of the first polarity in the triboelectric series; and an absorptive part which is formed by a surface treatment of the substrate and may electrostatically absorb the paper-like member, said absorptive part and said recorded medium being in a triboelectric series such that said absorptive part gets charged into a second polarity opposite to the first polarity in the triboelectric series when said recorded medium is fed by driving said feed belt.

* * * * *